US006293488B1

(12) United States Patent
Wells et al.

(10) Patent No.: US 6,293,488 B1
(45) Date of Patent: Sep. 25, 2001

(54) COORDINATE TRANSFORMATION SYSTEM

(75) Inventors: Michael L. Wells, Newhall; Thomas E. Jenkins, Los Angeles; Richard J. Sand, Torrance; Eric B. Sutton, Los Angeles, all of CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 08/339,847

(22) Filed: Nov. 15, 1994

(51) Int. Cl.[7] ..... F41G 7/00
(52) U.S. Cl. ..... 244/3.11
(58) Field of Search ..... 244/3.15, 3.16, 244/3.17, 3.19, 3.2, 3.21, 3.11

(56) References Cited

U.S. PATENT DOCUMENTS 3,829,659 * 8/1974 Margolis ..... 235/61.5 S
4,219,170 * 8/1980 Esker ..... 244/3.14
4,433,818 * 2/1984 Coffel ..... 244/3.13
4,641,801 * 2/1987 Lynch, Jr. et al. ..... 244/3.14
4,790,493 * 12/1988 Schwarzkopf et al. ..... 244/3.21
5,052,637 * 10/1991 Lipps ..... 244/3.15
5,253,823 * 10/1993 Lawrence ..... 244/3.15
5,263,662 * 11/1993 Fowler et al. ..... 244/17.13
5,429,322 * 7/1995 Waymeyer ..... 244/3.15

* cited by examiner

*Primary Examiner*—Harold J. Tudor
(74) *Attorney, Agent, or Firm*—Colin M. Raufer; Glenn H. Lenzen, Jr.

(57) ABSTRACT

A coordinate transformation apparatus (138) in an aircraft-based missile guidance and tracking system for adjusting aircraft and missile position signals for a roll angle about the line of sight in the guidance and tracking system sight unit (40) caused by roll of the aircraft subsequent to firing of the missile. The apparatus (138) incorporates analog to digital converter means (140), (144), (156), (160) and (180) to convert the analog aircraft and missile position signals to digital signals for input into a microprocessor (168). The microprocessor (168) computes the roll angle as well as a change in roll angle over time around the line of sight of the sight unit (40) and subsequently adjusts the digital signals to compensate for the computed roll angle and change in roll angle. Digital to analog converter means (182), (186) and (190) convert adjusted digital signals to analog signals and output the adjusted analog signals for computation of missile guidance signals by the system.

22 Claims, 4 Drawing Sheets

COORDINATE TRANSFORMATION SYSTEM

BACKGROUND OF THE INVENTION

1. Technical Field

This invention relates generally to an aircraft-based missile guidance and tracking system, and in particular to a subsystem for digitally computing the roll angle around the line of sight in optics incorporated in such a system, and for adjusting missile guidance signals to compensate for the computed roll angle, about the line of sight.

2. Discussion

A conventional aircraft-based missile guidance and tracking system includes target acquisition optics. An example of such optics is disclosed in U.S. Pat. No. 3,989,947, to Chapman entitled "Telescope Cluster." As disclosed in Chapman, a system operator locates a missile target and positions an image of the target at the intersection of cross hairs incorporated in the optics. After the operator fires the missile, the optics detect a tracking signal emitted by the missile. This tracking signal is then processed by system computers to produce a guidance signal transmitted to the missile to keep the missile on its intended course. Through use of such a system, a missile fired from an aircraft may be directed to its intended target with a high degree of accuracy.

The high degree of accuracy associated with the above-described typical guidance and tracking system is a result in great part to the system's capability of compensating for aircraft movement subsequent to the firing of the missile. As the system receives the missile tracking signal from the system optics, it processes this signal, along with aircraft position data received from aircraft instrumentation. The processed data is then used in the system missile guidance signals, sent from the system to the missile, to compensate for movement of the aircraft from the original aircraft-to-target coordinates, thus keeping the missile on its intended course.

In particular, one critical component that must be compensated for in the missile guidance signals is the roll of the aircraft around a line of sight of the system optics. For instance, once the missile is fired from the aircraft, it maintains the roll attitude of the aircraft at the time of launch, while the aircraft may roll to the right or left around the original line of sight after the missile is fired. Since the missile tracking system senses the missile positioned in aircraft coordinates, this roll must be corrected in order to stabilize the missile and to prevent the missile from deviating from its intended flight path to the target as the gunner maintains the cross hairs on the target as the aircraft moves.

In the past, roll angle compensation mechanisms incorporated in missile guidance and tracking systems have adjusted guidance commands for roll around the line of sight in system optics through use of electromechanical components, such as resolver/servo systems, to compute the roll angle and to correct the guidance signals output to the missile for the computed roll angle. As a result, however, the roll angle compensation mechanisms were relatively heavy and expensive due to the many mechanical components. In addition, the mechanical components often would go out of alignment due to vibration and wear. As a result, the reliability of such electromechanical error compensation mechanisms was limited.

What is needed then is a roll angle correction system which does not exhibit the limitations of previous electromechanical error mechanisms, and which is less expensive to implement than the previous mechanisms.

SUMMARY OF THE INVENTION

In accordance with the teachings of the present invention, a coordinate transformation system is provided for adjusting target tracking and missile position data for changes in aircraft position subsequent to the firing of a missile. The coordinate transformation system finds particular utility in an aircraft-based missile guidance and tracking system having a 2 degree of freedom gimbal-mounted sight unit for aiming at a missile target and for detecting a tracking signal generated by a roll stabilized missile in flight. The mechanism generates guidance signals which are transformed from aircraft coordinates to missile coordinates for guiding the missile to the target.

In the inventive approach, position sensors are provided for generating analog aircraft and missile position signals. Analog to digital converter means are used to convert the analog position signals into digital signals. Microprocessors are connected to the analog to digital converter for computing a roll angle around the line sight of the system sight unit. A microprocessor adjusts the digital signals to compensate for the roll angle. Digital to analog converter means are then used for converting the adjusted digital signals to analog signals, and for outputting the adjusted analog signals to the system for computation of the guidance signals transmitted to the missile.

In addition, sight tracking commands which require compensation in earth coordinates are transformed from aircraft coordinates to earth coordinates, compensated for gravity, then retransformed into aircraft coordinates for use by a digital control mechanism of the stabilized sight.

BRIEF DESCRIPTION OF THE DRAWINGS

The various advantages of the present invention will become apparent to those skilled in the art after studying the following disclosure by reference to the drawings in which.

DETAILED DESCRIPTION

The following description of the preferred embodiments is merely exemplary in nature and is in no way intended to limit the invention or its application or uses.

Figure 1:
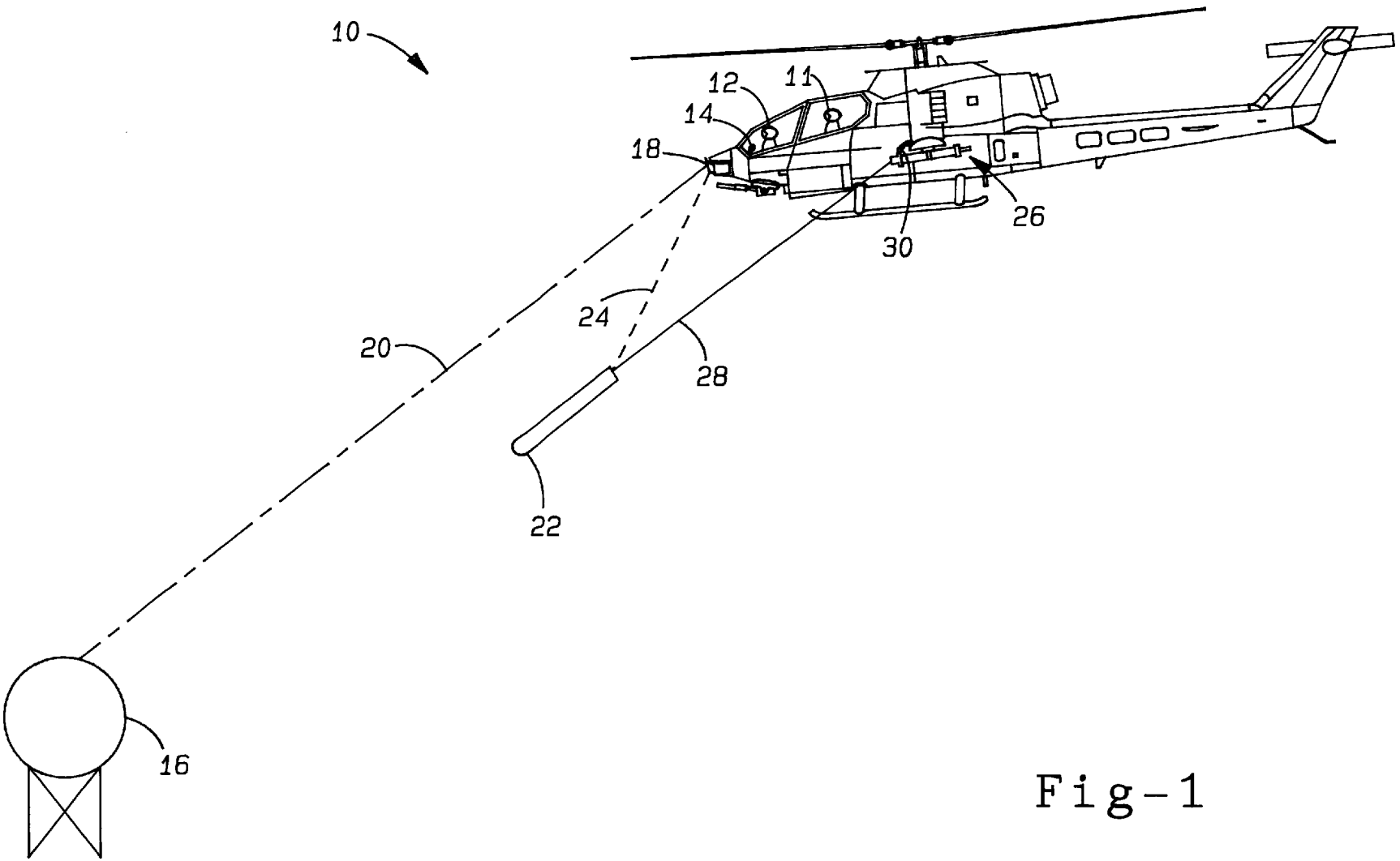
FIG. 1 is a side elevation view of an aircraft in which the present invention is implemented.

Referring to the drawings, FIG. 1 illustrates a side view of a helicopter, shown generally at 10, in which the present invention is implemented. Preferably, this is a AH-1 series Cobra attack helicopter. However, it is contemplated that the invention may also be implemented in a 500 MD series attack helicopter, or in other types of aircraft employing guided missile systems. As is shown, as pilot 11 files the helicopter, system operator, or gunner, 12 uses an eyepiece 14, to locate missile target 16. System operator 12 uses eyepiece 14 to view an image of target 16 as detected by optics 18. Optics 18 are preferably of the type shown and described in detail in U.S. Pat. No. 3,989,947 to Chapman entitled "Telescope Cluster," which is assigned to Hughes Aircraft Company, the Assignee of this invention, and which is incorporated herein by reference. As disclosed in Chapman, optics 18 detect the target, as represented by line 20.

In addition, optics 18 detect missile 22 via tracking signal 24 emitted by missile 22 after the missile is fired from missile firing mechanism 26. Typically, this tracking signal is the infrared radiation emitted from a source in the missile. Tracking signal 24 is processed by the missile guidance and tracking system as will be described in more detail below. The system uses the processed tracking signal to compute missile guidance signal 28, which is transmitted to the missile to keep the missile from deviating from its intended course. The missile guidance signal may be communicated to missile 22 via either a wire or wireless connection, dependant upon the type of system implemented, and is transmitted from the guidance and tracking system within aircraft 10 through external umbilical connection 30 and missile launcher 32 to missile 22, or a separate antenna (not shown).

Missile 22 is preferably a TOW missile implemented in one of the TOW missile systems well known to those skilled in the art. The present invention is preferably implemented in one of these TOW missile systems, such as the M-65 system that is shown for exemplary purposes in block diagram form in FIG. 2. While the block diagram in FIG. 2 illustrates an M-65 TOW missile system, it should be appreciated by those skilled in the art, upon reading the detailed description below, that the present invention may also be implemented in other TOW missile systems, such as the M-65, M-65/LAAT, M-65 C-NITE and TAMAM Night Targeting System (NTS or NTS-A) Systems and other aircraft-based missile and guidance tracking systems incorporating many of the same, or similar, components of the above-described M-65 TOW missile system.

The M-65 system, shown generally at 36, includes stabilization control amplifier (SCA) 38, telescopic sight unit (TSU) 40, having an error detector computer 42, and missile command amplifier (MCA) 44. SCA 38 sends the pilot steering commands, indicated at 46, to head up display 47 to indicate to the pilot the position of the sighting optics with respect to the aircraft. SCA 38 receives, from pilot/gunner helmet sight 48, acquisition commands 50, representing target location, when acquired using the helmet sight, and gunner 12 then generates commands 54 from sight hand control 52 for tracking the target 16. In addition, SCA 38 also receives commands 56 from TOW control panel 58. These TOW control panel commands 56 result from pilot master arm commands 57, and system mode commands from the gunner 12.

SCA 38 also receives data 60 concerning aircraft air speed from air speed sensor 62 and data 64 representing aircraft pitch angle and aircraft roll angle from aircraft vertical gyro sensor 66. In addition, SCA receives error signals 72 processed from data received from on gimbal elevation and azimuth gyros and accelerometers and returns azimuth and elevation stabilization commands 72 to stabilize gimbal mounted telescope cluster (not shown) of TSU 40 as disclosed in Chapman.

Figure 2:
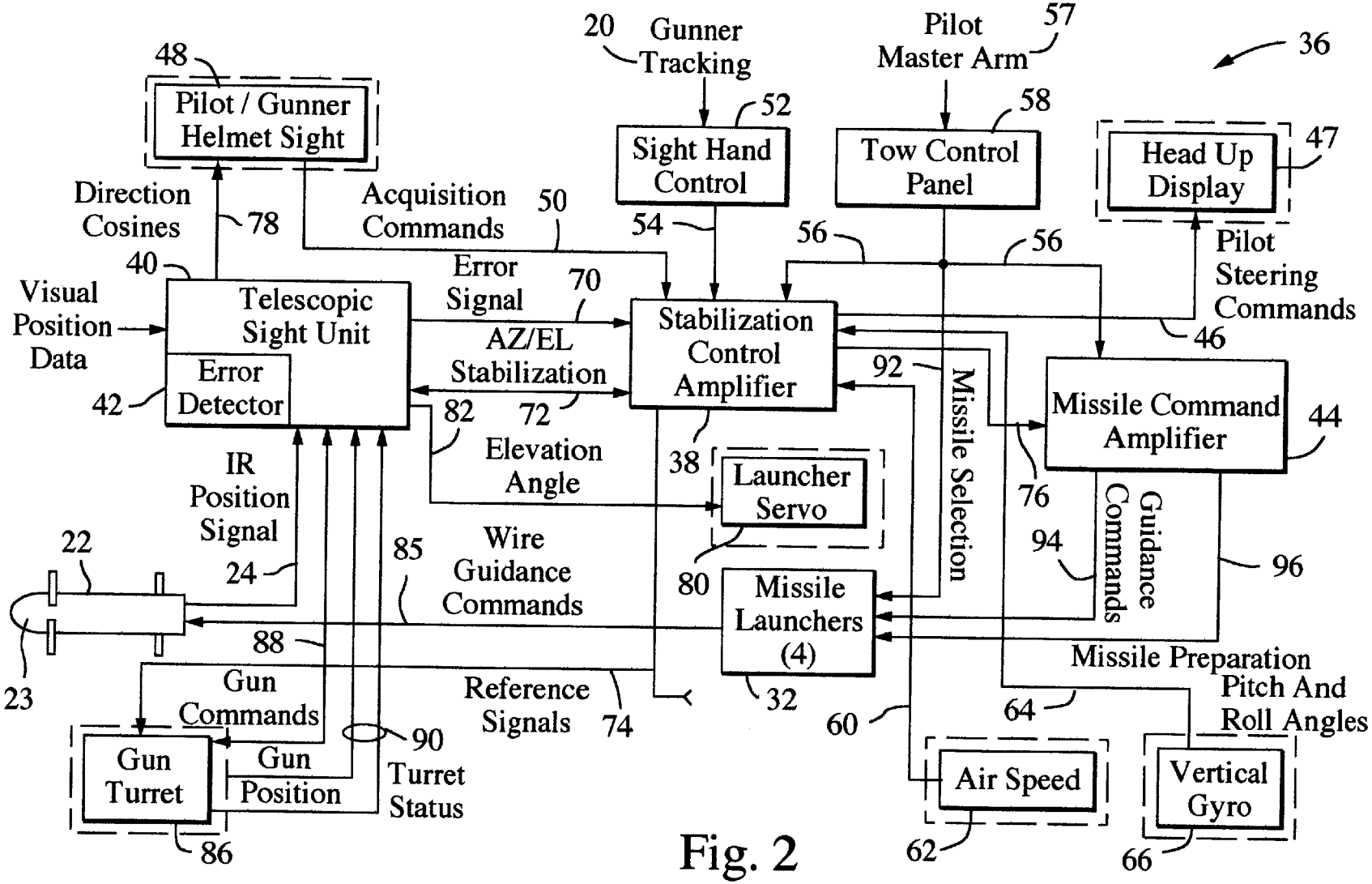
FIG. 2 is a simplified block diagram of a representative missile system in which the present invention is implemented.

Still referring to FIG. 2, TSU 40, in addition to being connected to SCA 38, is also connected to pilot/gunner helmet sight 48 for providing the sight with direction cosines 78 for acquisition purposes. TSU 40 is also connected to launcher servo 80 to provide aircraft elevation angle data 82 to the servo to allow missile launcher 32 to be correctly positioned before firing missile 22. TSU 40 is also connected to gun turret 86 to provide gun position commands 88 and to receive gun position data 90 from turret 86.

Again referring to FIG. 2, in addition to receiving steering data from SCA 38 for output to missile 22, MCA 44 is connected to missile launchers 32 for missile selection, as determined by the TCP 58 or other controlling device indicated at 92, for providing wire guidance commands 85 to missile launchers 32 through guidance commands 94 and for providing missile preparation commands 96, such as prefire signals, to missile 22 through missile launchers 32.

Figure 3:
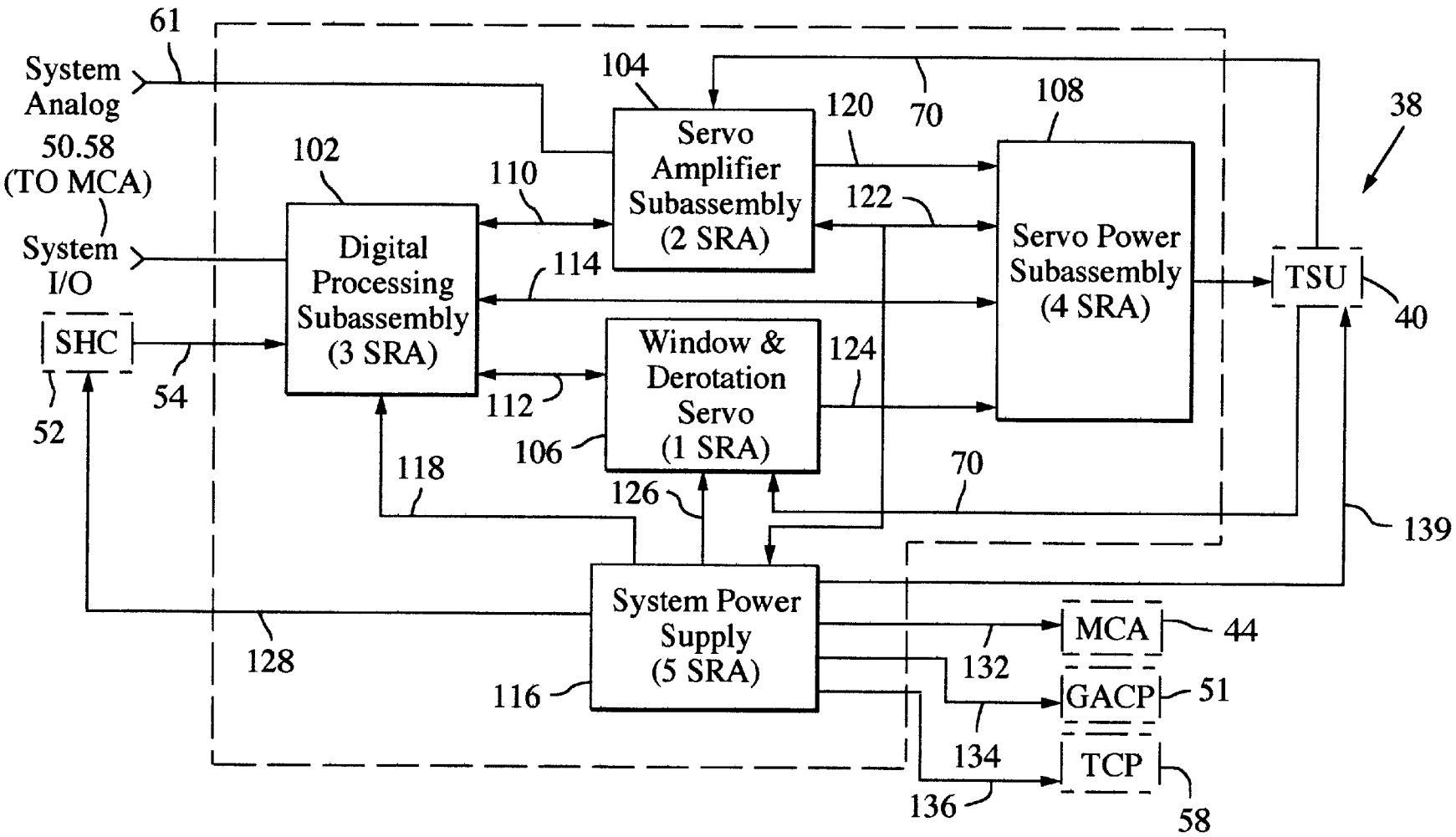
FIG. 3 is a simplified block diagram of the stabilization control amplifier shown in FIG. 2.

Turning now to FIG. 3, SCA 38 is shown in more detail. SCA 38 includes digital processing subassembly 102 for processing digital input commands such as system mode commands 50 and TOW control panel commands 58, as well as sight hand control commands 54. Digital processing subassembly 102 also outputs commands, as discussed above with respect to SCA 38 in FIG. 2, to MCA 44. Digital processing subassembly 102 is in communication with servo amplifier subassembly 104, window and derotation servo 106 and servo power subassembly 108 through lines 110, 112 and 114, respectively. Digital processing subassembly 102 also receives power from system power supply 116 through line 128, as do servo amplifier subassembly 104, window and derotation servo 106, servo power subassembly 108, sight hand control 52, TSU 40, MCA 44, GACP 51 and TCP 58 through lines 122, 126, 122, 128, 130, 132, 134 and 136, respectively.

Servo amplifier subassembly 104 receives system analog data, such as data from TSU gyros as well as command signal data from the digital processing subassembly 102. Servo amplifier subassembly 104 provides selectable gain and frequency compensation for the analog control of the gimbal mounted gyros as well as SHC track stick commands (via line 110) and acquisition commands from the helmet sight system via system analog input 61. Servo amplifier subassembly 104 also provides phase detection, filtering and amplification for the motor commands sent to servo power subassembly 108.

Still referring to FIG. 3, window and derotation servo 106 receives error signal data 70 from TSU 40. The derotation error signals are processed and amplified to rotate a prism (not shown) within the optical train of TSU 40 to cause the target image to remain erect as the sight optics are slewed up, down, left and right. The window error signals are processed and amplified to cause the outer turret (not shown) of TSU 40, which protects the stabilized optics from wind buffeting, to track the azimuth position of the optics in a decoupled manner.

Servo power subassembly 108 sends built-in test data to digital processing subassembly 102, and receives signals from servo amplifier subassembly 104 and window and derotation servo 106 through lines 114, 120 and 124, respectively. Servo power subassembly then passes processed signals to TSU 40 to stabilize the TSU azimuth and elevation channels, and drive the derotation prism and window turret.

Figure 4:
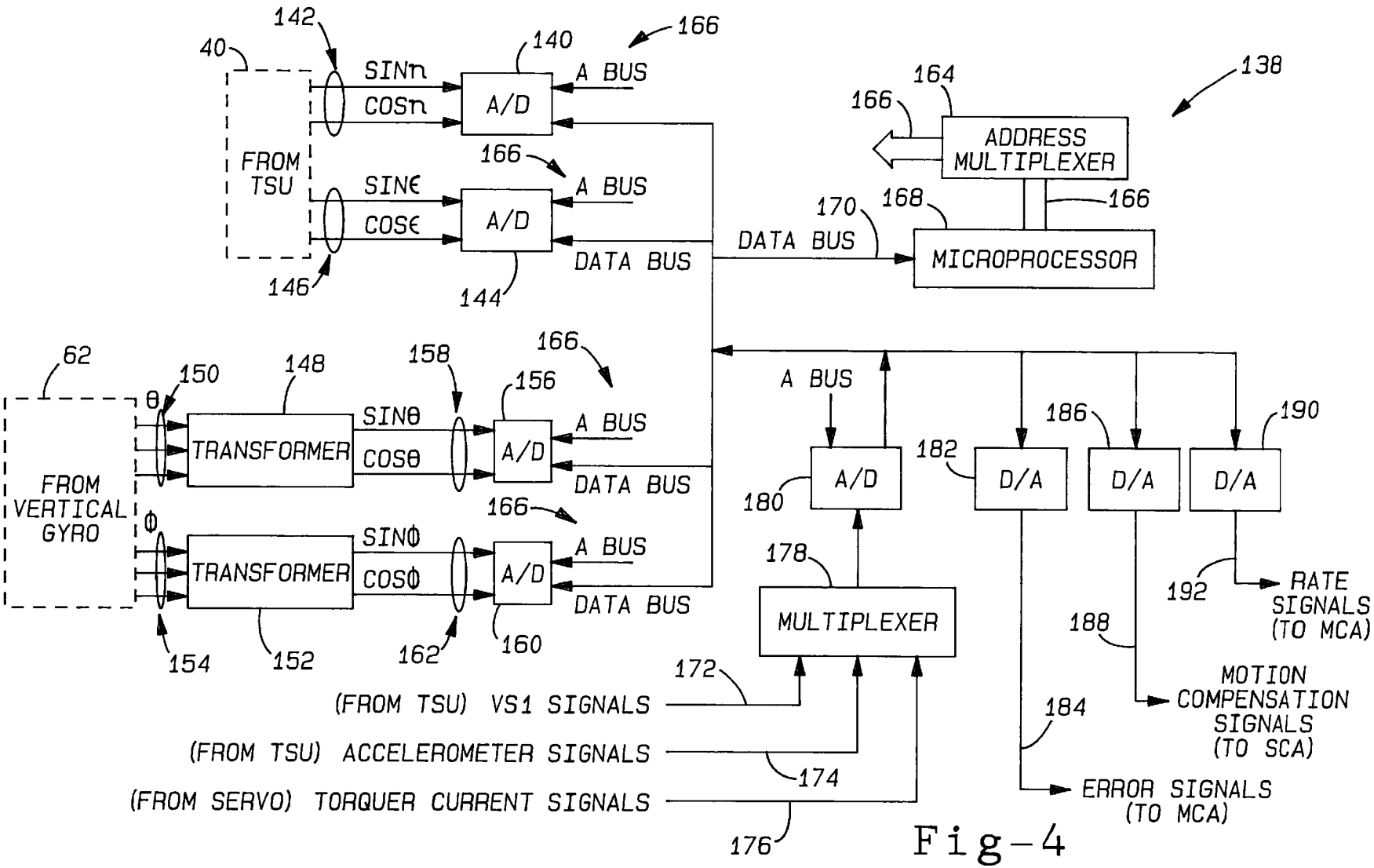
FIG. 4 is a block diagram of the coordinate transformation system according to the present invention.

Turning now to FIG. 4, a block diagram of the roll compensation system of the present invention is shown generally at 138. This system is incorporated into digital processing subassembly 102 of SCA 38, and outputs data to MCA 44 and eventually to TSU 40. The symbols below will be used in the following discussion of the present invention:

$\eta$=sight azimuth angle $\in$=sight elevation $\phi$=aircraft roll angle $\theta$=aircraft pitch angle As shown in FIG. 4, sensors positioned in gimbal-mounted TSU 40 measure both sine $\eta$ and cosine $\eta$ and input these values into analog to digital converter 140 through inputs 142. Similarly, TSU 40 measures sine $\in$ and cosine $\in$ and inputs these values into analog to digital converter 144 through inputs 146.

Vertical gyro sensor 66 measures the value for θ and inputs the three phase value into transformer 148 through inputs 150. Similarly, vertical gyro sensor 62 measures the value for ϕ and inputs this three phase value into transformer 152 through inputs 154. The transformers used to convert these three phase values into two phase values are preferably Scott Tee Transformers, although electronic means could be used. Transformer 148 outputs values for sine ϕ and cosine ϕ to analog to digital converter 156 through outputs 158. Transformer 152 outputs values for sine ϕ and cosine ϕ to analog to digital converter 160 through outputs 162. Analog to digital converters 140, 144, 156 and 160 are in communication with address multiplexer 164 through address bus 166 and with microprocessor 168 through data bus 170 for reasons set forth in detail below.

Processed error signals 172 from TSU error detector 42 (hereinafter referred to as VS 1 signals) corresponding to signals detected by the azimuth and elevation detector legs of TSU 40, are input into multiplexer 178, as are accelerometer signals 174, measured by azimuth and elevation accelerometers mounted to the gimbal of TSU 40, and torquer current signals 176, measured from the gimbal servo of TSU 40 and representing the rate of the gimbal. The signals are then multiplexed and converted to digital signals through analog to digital converter 180. Analog to digital converter 180 in turn is connected to address multiplexer 164 through address bus 166 and to microprocessor 168 through data bus 170.

Still referring to FIG. 4, operation of the present invention will now be described. Address multiplexer 164 selects data from analog to digital converters 140, 144, 156 and 160 as data is needed by microprocessor 168 for performing digital coordinate transformation calculations to compute, and to compensate for, the roll angle around the line of sight in TSU 40.

As analog to digital converters digitally convert analog resolver-generated data from TSU 40 and vertical gyro sensor 62, VS 1 signals 172 and accelerometer signals 174, as well as torquer current signals 176 from a servo (not shown) driving the gimbal-mounted TSU 40 are input into multiplexer 178. The multiplexed signals are then input into analog to digital converter 180.

Microprocessor 168 then communicates with analog to digital converters 140, 144, 156, 160 and 180 through address multiplexer 164 and address bus 166 and, through this communication, selects digital data over address bus 166 and receives the digital data over data bus 170. By being programmed in a manner well known to those skilled in the art, and through associated software, microprocessor 168 computes the following roll angle equation:

$$Rho = \tan^{-1}\left[\frac{\tan\theta\sin\eta + \sin\phi\cos\eta}{\cos\phi\cos\epsilon + \sin\phi\sin\eta\sin\epsilon - \tan\theta\cos\eta\sin\epsilon}\right]$$

The computation of Rho is required to determine the change in Rho angle from the time of missile launch.

Microprocessor 168 and associated software then adjust VS 1 signals 172 and torquer current signals 176 to compensate for Rho. The signals are processed using standard Rho resolver equations as shown below:

Yaw Error=Azimuth VS1*(CosΔRho)+Elevation VS1*(SinΔRho)

Pitch Error=Elevation VS1*(CosΔRho)−Azimuth VS1*(SinΔRho)

Yaw Rate=$K_1$[Azimuth TC*(CosΔRho)+Elevation TC*(SinΔRho)]

Pitch Rate=$K_1$[Elevation TC*(CosΔRho)−Azmith TC*(SinΔRho)]

Where:

Azimuth or Elevation refers to aircraft coordinates;

Yaw or Pitch refers to missile coordinates;

ΔRho=Rho at missile launch—current Rho angle;

Rho=Roll around the line of sight;

TC=Torquer Current (scaled); and $K_1$=Scaling Factor

Adjusted VS 1 signals are output through digital to analog converter 182 as error signals 184 and are transmitted to MCA 44 to enable MCA 44 to compute guidance commands for missile 22 in a manner well known to those skilled in the art. Adjusted torquer current signals are output through digital to analog converter 190 as rate signals 192, which are transmitted to MCA 44 also to enable MCA 44 to compute missile guidance commands.

Processing of VS 1 signals 172 and torquer current signals 176 also sets the rate at which the Rho angle must be computed, as the Rho angle must be updated due to the latency of the processing of the signals. The rates of the VS 1 and torquer current signals determine how often the Rho angle must be computed. Typically, these signals are processed at a rate of 120 Hz.

In addition, microprocessor 168 and associated software continuously adjust accelerometer signals 174 from elevation and azimuth gimbal mounted accelerometers (not shown) of the aircraft by translating the accelerometer signals into earth coordinates for removal of the effect of gravity on the accelerometers. After the effect of gravity has been removed from the translated earth coordinates, the adjusted signals are then converted back into aircraft coordinates and are output through digital to analog converter 186 as motion compensation signals 188. Signals 188 are then processed through stabilization control amplifier 38 to adjust the signals input into the elevation and azimuth gimbal motors in TSU 40 for stabilization purposes.

As can be appreciated, the coordinate adjustment system disclosed herein can be easily implemented in new and existing aircraft based missile guidance and tracking systems. Implementation of the present invention eliminates many expensive electromechanical devices associated with prior signal adjustment systems. Eliminating many of the electromechanical devices associated with prior systems also simplifies system design and increases the reliability of the system. In addition, the adjustment system increases the accuracy over time of the missile guidance and tracking system in which it is implemented.

Various other advantages of the present invention will become apparent to those skilled in the art after having the benefit of studying the foregoing text and drawings, taken in conjunction with the following claims.

What is claimed is:

1. An aircraft-based missile guidance and tracking system including a sight unit mounted on a gimbal for aiming at a missile target and for detecting a tracking signal generated by a missile in flight, and a mechanism for generating guidance signals for guiding said missile to said target, comprising:

position sensors for generating analog aircraft and missile position signals;

analog to digital converter means for converting said analog position signals into digital signals;

a microprocessor connected to said analog to digital converter for computing a roll angle and change of roll angle around a line of sight of said sight unit, said microprocessor adjusting said digital signals to compensate for said roll angle; and digital to analog converter means for converting said adjusted digital signals to analog form, and for outputting said adjusted analog signals to said system for computation of said guidance signals.

2. The system of claim 1, wherein said position sensors comprise elevation and azimuth detectors in said sight unit for measuring sight azimuth and sight elevation angles.

3. The system of claim 1, further comprising accelerometers mounted to said sight unit for measuring acceleration of said gimbal in both azimuth and elevation directions.

4. The system of claim 3, wherein said microprocessor further translates signals from said accelerometers into earth coordinates, removes a gravity component from said coordinates, converts said adjusted earth coordinates into aircraft coordinates and uses said adjusted aircraft coordinates to aid tracking of said sight unit gimbal.

5. The system of claim 1, wherein said position signals comprises aircraft roll angle, aircraft pitch angle, sight azimuth angle and sight elevation angle.

6. The system of claim 1, wherein said position signals comprises an error voltage signal corresponding to missile position and a torquer current signal representing a rate of a servo in communication with said gimbal.

7. The system of claim 1, wherein said adjusted guidance signals comprise error and rate signals used in computing said guidance signal, and a motion compensation signal for stabilizing said sight unit gimbal for aircraft motion around said line of sight.

8. The system of claim 1, wherein said analog to digital converter means comprises:

a first analog to digital converter for converting said signals for sight azimuth angle into digital signals;

a second analog to digital converter for converting said signals for sight elevation angle into digital signals;

a third analog to digital converter for converting said signals for aircraft roll angle into digital signals; and a fourth analog to digital converter for converting said signals for aircraft pitch angle into digital signals.

9. The system of claim 8, further comprising:

a first transformer for receiving three phase analog signals corresponding to said aircraft roll angle and converting said three phase signals into two phase signals for input into said third analog to digital converter; and a second transformer for receiving three phase signals corresponding to aircraft pitch angle and converting said three phase signals into two phase signals for input into said fourth analog to digital converter.

10. An aircraft-based missile guidance and tracking system, comprising:

gimbal-mounted sight unit means for aiming at a missile target and for detecting a tracking signal generated by a missile in flight;

means for measuring aircraft and missile position signals;

means for inputting commands to said system, said means for inputting commands in communication with said sight unit means and said signals measuring means;

means for generating guidance signals for guiding said missile to said missile target including;

position sensors for generating analog aircraft and missile position signals;

analog to digital converter means for converting said analog position signals into digital signals;

a microprocessor connected to said analog to digital converter for computing a roll angle around a line of sight of said display, said microprocessor adjusting said guidance signals to compensate for said roll angle; and digital to analog converter means for converting said adjusted guidance signals to analog form, and for outputting said adjusted analog signals to said guidance signal generating means for computation of said guidance signals.

11. The system of claim 10, wherein said position sensors comprise elevation and azimuth detectors in said sight unit for measuring sight azimuth and sight elevation angles.

12. The system of claim 10, further comprising accelerometers mounted to said sight unit for measuring acceleration of said gimbal in both azimuth and elevation directions.

13. The system of claim 12, wherein said microprocessor further translates signals from said accelerometers into earth coordinates, removes a gravity component from said coordinates, converts said adjusted earth coordinates into aircraft coordinates and uses said adjusted aircraft coordinates to aid target tracking of said sight unit gimbal.

14. The system of claim 10, wherein said position signals comprises aircraft roll angle, aircraft pitch angle, sight azimuth angle and sight elevation angle.

15. The system of claim 10, wherein said position signals comprises an error voltage signal corresponding to missile position and a torquer current signal representing a rate of a servo in communication with said gimbal.

16. The system of claim 10, wherein said adjusted guidance signals comprise error and rate signals used in computing said guidance signal, a motion compensation signal to aid target tracking of said sight unit gimbal to aid target tracking for aircraft motion around said line of sight.

17. In an aircraft-based missile guidance and tracking system, including a sight unit mounted on a gimbal for aiming at a missile target and for detecting a tracking signal generated by a missile in flight, and a mechanism for generating guidance signals for guiding said missile to said target, a method for digitally transforming aircraft coordinates to compensate for aircraft movement subsequent to launching of said missile, comprising the steps of:

sensing aircraft and missile position signals;

converting analog position signals into digital signals;

computing a roll angle and change in roll angle around a line of sight of said sight unit from said digital position signals;

adjusting said digital position signals to compensate for said roll angle;

converting said adjusted position signals to analog form; and outputting said adjusted analog position signals to said system for computation of said guidance signals.

18. The method of claim 17, further comprising the step of providing accelerometers in communication with said sight unit to measure a gimbal rate of said sight unit gimbal.

19. The method of claim 17, further comprising the steps of:

adjusting said sight unit by translating signals from said sight unit accelerometers from aircraft coordinates into earth coordinates;

adjusting said earth coordinates by removing a component of gravity from said earth coordinates;

converting said adjusted earth coordinates back into aircraft coordinates; and using said adjusted aircraft coordinates to stabilize said sight unit.

20. The method of claim 17, further comprising the step of providing a microprocessor for computing said roll angle and adjusting said digital position signals.

21. The method of claim 17, further comprising the step of multiplexing said digital aircraft and missile position signals before said step of computing said roll angle.

22. An aircraft-based missile guidance and tracking system including a sight unit for aiming at a missile target and for detecting a tracking signal generated by a missile in flight, and a mechanism for generating guidance signals for guiding said missile to said target, comprising:

position sensors for measuring a first set of analog aircraft and missile position signals;

first analog to digital converter means having a plurality of inputs connected to said position sensors and a plurality of outputs, said first analog to digital converter means for converting said analog position signals into digital signals;

a microprocessor for performing digital coordinate transformation functions, said microprocessor having both an address bus and a data bus;

a multiplexer having a plurality of inputs and an output, said inputs of said multiplexer receiving a second set of analog aircraft and missile position signals, said multiplexer being connected to address multiplexer through said address bus;

second analog to digital converter means connected between said output of said multiplexer and said data bus of said microprocessor, said second analog to digital converter means operative for converting said second set of position analog signals into digital signals;

said microprocessor computing roll angle around line of sight from said first set of position signals, said microprocessor transforming said digital signals to adjust said digital signals for said roll angle around said line of sight; and a digital to analog converter for converting said adjusted second set of digital signals into analog signals for further processing by said missile guidance and tracking system.

* * * * *